US005377587A

United States Patent [19]

Köbler

[11] Patent Number: 5,377,587

[45] Date of Patent: Jan. 3, 1995

[54] SHEET-FED ROTARY PRINTING PRESS WITH INSPECTION-SHEET DELIVERY

[75] Inventor: Eckhard Köbler, Heidelberg, Germany

[73] Assignee: Heidelberger Druckmaschinen AG, Heidelberg, Germany

[21] Appl. No.: 168,046

[22] Filed: Dec. 15, 1993

[30] Foreign Application Priority Data

Dec. 15, 1992 [DE] Germany ..... 4242259

[51] Int. Cl.[6] ..... B41F 13/24

[52] U.S. Cl. ..... 101/233; 101/238; 250/571; 250/572; 364/580; 364/710.13

[58] Field of Search ..... 101/232, 233, 238, 240, 101/216; 250/571, 572; 364/471, 580, 710.13

[56] References Cited

U.S. PATENT DOCUMENTS

| | | | |
|---|---|---|---|
| 3,051,841 | 8/1962 | Fothergill et al. . | |
| 3,907,274 | 9/1975 | D'Amato et al. | 101/232 |
| 4,774,446 | 9/1988 | Salazar et al. | 101/233 |
| 5,029,525 | 7/1991 | Jeschke | 101/232 |
| 5,114,138 | 5/1992 | Ichinose | 101/233 |
| 5,213,036 | 5/1993 | Tukuno et al. | 101/232 |

FOREIGN PATENT DOCUMENTS

| | | | |
|---|---|---|---|
| 0427975 | 5/1991 | European Pat. Off. . | |
| 1112536 | 8/1961 | Germany . | |
| 3015103 | 10/1981 | Germany . | |
| 3938138 | 5/1991 | Germany . | |
| 2078550 | 3/1990 | Japan | 101/232 |
| 921064 | 10/1960 | United Kingdom . | |
| 2107647 | 5/1983 | United Kingdom | 101/232 |

*Primary Examiner*—Eugene H. Eickholt

*Attorney, Agent, or Firm*—Herbert L. Lerner; Laurence A. Greenberg

[57] ABSTRACT

A delivery system in a sheet-fed rotary printing press includes at least one main sheet pile, and at least one auxiliary pile for an inspection-sheet delivery; a conveying device for transporting sheets; release members for releasing the sheets from the conveying device above one of the main and auxiliary piles; a sensor device for detecting the position of the respective sheets, the sensor device having a capability of emitting electrical pulses to an electronic computer for controlling the printing press, the electronic computer being actuatable for recording measured data, for documenting the measured data with respect to pertinence thereof to respective inspection sheets, for automatically delivering inspection sheets and for setting an inspection-sheet delivery cycle.

7 Claims, 3 Drawing Sheets

SHEET-FED ROTARY PRINTING PRESS WITH INSPECTION-SHEET DELIVERY

SPECIFICATION

The invention relates to a sheet-fed rotary printing press with a delivery system having at least one main sheet pile, and at least one auxiliary pile for an inspection-sheet delivery; conveying means for transporting sheets; release members for releasing the sheets from the conveying means above one of the main and auxiliary piles; sensor means for detecting the position of the respective sheets and having means for emitting electrical pulses to an electronic computer for controlling the printing press.

A printing press generally having the foregoing structural features has become known heretofore from the published German Patent Document 30 15 103 A1 in connection with a device for a separate delivery of mis-fed sheets which do not conform to quality requirements. In this regard, the positional alignment of a sheet to be printed is checked by sensors before the sheet enters a printing unit and, in the last printing unit, the color intensity of the printed sheet is registered by a densitometer, both the sensors and the densitometer generating corresponding electrical pulses which are fed to an evaluation circuit and, if prescribed tolerance values should be exceeded, cause the sheet to be separated out and deposited on an auxiliary pile of mis-fed sheets.

A sheet-fed rotary printing press with a sheet delivery permitting the removal of inspection sheets in order to ensure uniform print quality has become known heretofore from the published German Patent Document 11 12 536 C2. This publication describes a sheet delivery with grippers disposed on revolving conveying chains and gripping a sheet at its leading side for transport, release members for opening the grippers, and an auxiliary-pile table disposed between two alternately operated main-pile tables and having a fixed stop assigned thereto for opening the grippers. Movable release members for opening the grippers are provided for the main-pile tables. These release members are controlled by a counting unit driven in the printing press, the drive of the counting unit being interrupted during travel of the sheet when, through random disengagement of the release members causing the opening of the grippers above one of the two main-pile tables, an inspection sheet is delivered. The removal of inspection sheets is thus randomly triggered manually by the pressman.

Due to increasing quality requirements, it has already become customary to record a protocol, i.e., maintain a log of the printing process. The computer control of such high-performance printing presses also permits the electronic recording of setting or adjustment data and of measured data registered during the production run.

It is an object of the invention to provide a sheet-fed rotary printing press with an inspection-sheet delivery wherein the removal of an inspection sheet is performed automatically, and the documentation of specific printing-press setting data and of measured data recorded during the production run with respect to the printing quality of the sheet is assigned to the respective inspection sheet.

With the foregoing and other objects in view, there is provided, in accordance with the invention, in a sheet-fed rotary printing press, a delivery system comprising at least one main sheet pile, and at least one auxiliary pile for an inspection-sheet delivery; conveying means for transporting sheets; release members for releasing the sheets from the conveying means above one of the main and auxiliary piles; sensor means for detecting the position of the respective sheets, the sensor means having means for emitting electrical pulses to an electronic computer for controlling the printing press, the electronic computer being actuatable for recording measured data, for documenting the measured data with respect to pertinence thereof to respective inspection sheets, for automatically delivering inspection sheets and for setting an inspection-sheet delivery cycle.

In accordance with another feature of the invention, the delivery system includes a printer for printing the measured data regarding the inspection sheets in conjunction with a code indicating the pertinence of the measured data to the respective inspection sheets, the printer being connected to the computer controlling the inspection-sheet delivery.

In accordance with an added feature of the invention, the delivery system includes means provided in the electronic computer for initiating a signal, by electronic counting, for disabling the release members from releasing the sheets above the main pile, for transporting the sheets by the conveying means to the auxiliary pile for inspection-sheet acceptance, and for actuating fixedly disposed release members to release the sheets above the auxiliary pile.

In accordance with an additional feature of the invention, the delivery system includes a coding unit for coding the inspection sheets with pertinent stored data.

In accordance with yet another feature of the invention the coding unit for coding the inspection sheets comprises a printer.

In accordance with yet a further feature of the invention, the printer is an ink-jet printer.

In accordance with a concomitant feature of the invention, the coding unit for coding the inspection sheets comprises a numbering box.

An advantage derived from the foregoing structural features of the invention is that, at the electronic printing-press control, the pressman can not only preselect the length of run, but also a quality-sheet cycle, which leads to an automatic inspection-sheet delivery during printing, and to the documentation of associated printing-press setting data, such as dampening, inking and register, in the electronic printing-press control computer, the data then being printed out with a symbol, such as a registration number or the like, identifying the appertaining inspection sheet. Thus, a relationship, which is beyond the control of the pressman, is established between the generated documentation and the inspection sheet identified in that documentation. With the inspection-sheet cycle having been selected, to effect an inspection sheet delivery, electronic counting in the computer initiates a signal for the release members to release of the sheet above the main pile, so that the conveying means in the delivery transport the sheet farther to the auxiliary pile for inspection-sheet acceptance. The release members for effecting the sheet release in the auxiliary pile may be arranged in a fixed position because, at that location, all sheet-transport means are opened or have already been opened.

The aforementioned features of the delivery system according to the invention are provided preferably in a sheet-fed rotary offset printing press with conveying means formed of revolving chains to which grippers are attached which grip the sheets at the leading edge thereof.

Other features which are considered as characteristic for the invention are set forth in the appended claims.

Although the invention is illustrated and described herein as embodied in a sheet-fed rotary printing machine with an inspection-sheet delivery, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
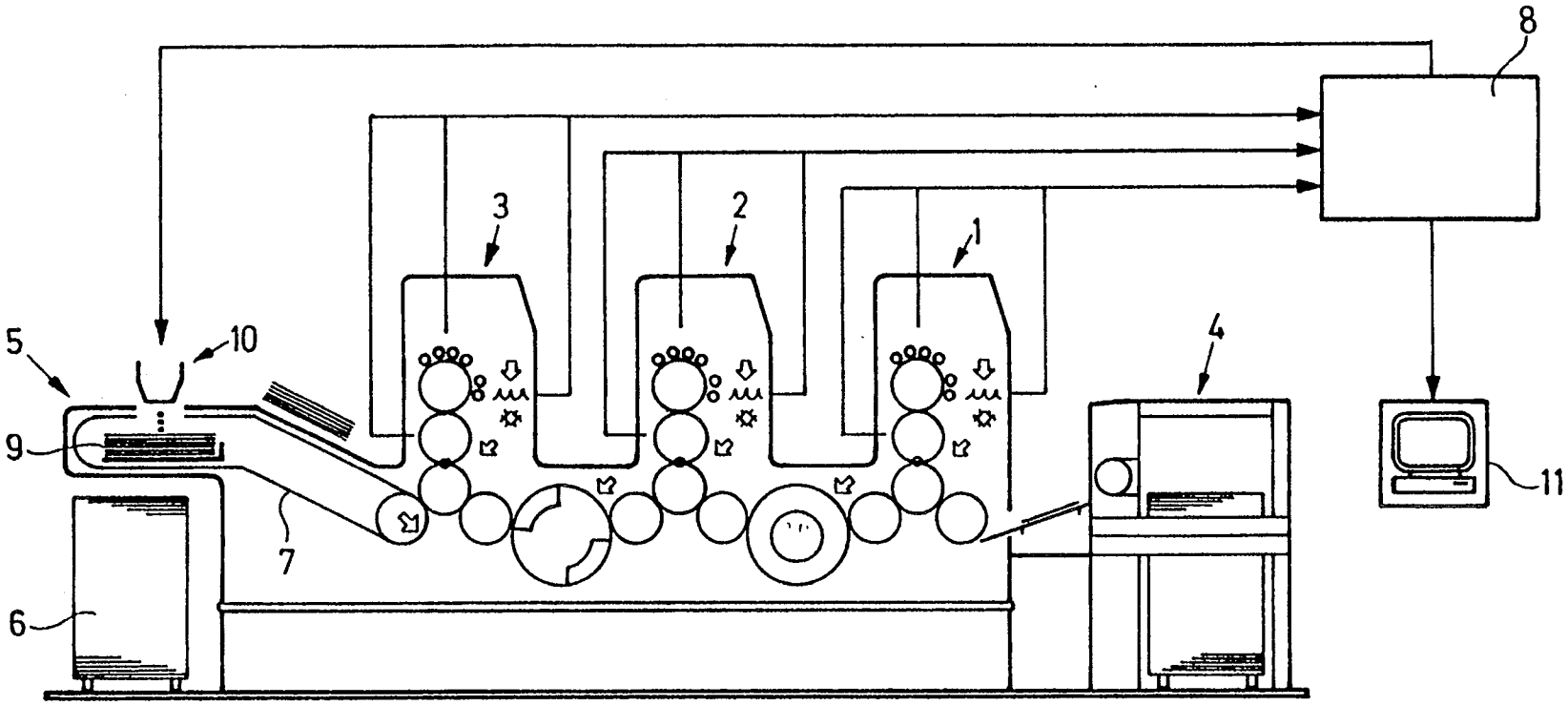
FIG. 1 is a schematic and diagrammatic side elevational view of a printing press having a plurality of in-line printing units, a feeder and an embodiment of the delivery constructed in accordance with the invention.
Figure 2:
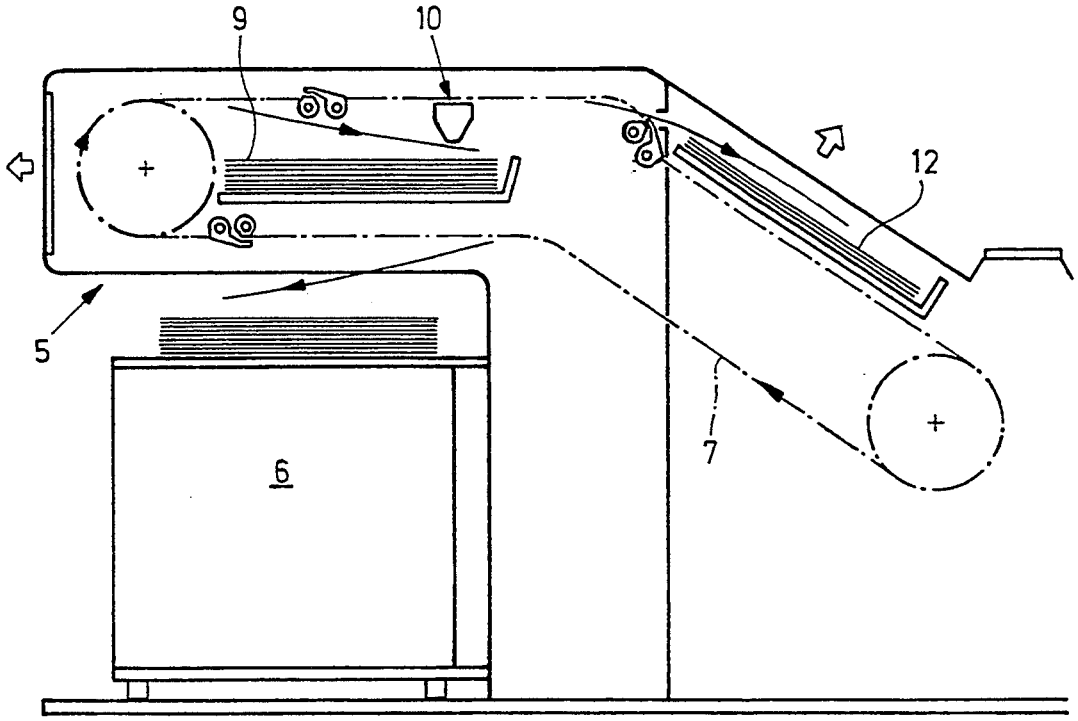
FIG. 2 is an enlarged fragmentary view of FIG. 1 showing another embodiment of the sheet delivery in greater detail.

Referring now to the FIGS. 1 and 2 of the drawing, there is shown therein a sheet-fed rotary offset printing press having arbitrarily three in-line printing units 1, 2 and 3, a feeder 4, disposed forward of the first printing unit 1, and a delivery 5, disposed after the last printing unit 3, for delivery of the sheets onto a sheet pile 6. Disposed in the delivery 5 are conveying means formed of revolvingly driven conveying chains 7, to which gripper bars are attached. The gripper bars carry grippers which grip the sheets by the leading edge thereof for transport and which are opened above the sheet pile 6 by control cams which, in the interest of clarity, are not shown in the drawing. Specific setting data of the printing units 1 to 3 is recorded during a production run and is fed in the form of electrical pulses to an electronic computer 8. A coding unit 10, such as a numbering box, a printer, more particularly an ink-jet printer, or the like, which is controlled by the computer 8, is provided in the delivery 5 above the auxiliary pile 9 for the inspection sheets which are to be deposited on the auxiliary pile 9. The computer 8 is equipped with an integrated counting unit and is connected to a printer 11 which, in conjunction with the code applied to the inspection sheet by the coding unit 10, permits a printout of the documentation of the specific measured values on the last printing unit 3 or also of further printing units 1 and 2. In the preselected cycle for inspection-sheet removal, the measured data which has been recorded in the last printing unit 3 or also in a plurality of printing units is stored in the computer, so that the data are permanently assigned by the computer program to the inspection sheet after the inspection-sheet cycle, the pressman having no control over this assignment. The central computer for controlling the printing press may simultaneously be employed as the computer 8 for the inspection-sheet removal, however, if necessary or desirable, an additional computer may be provided in conjunction with the central computer for the printing-press control. In the case of conventional gripper controls in the delivery of a sheet-fed printing press, the signal initiated in the preselected inspection-sheet cycle for inspection-sheet delivery is converted into an axial displacement of a gripper-opening cam, so that the cam is rendered inoperative for this inspection sheet. Thereafter, the opening cam returns to its starting position. Accordingly, the inspection sheet is not released above the main pile 6, but is transported on to the auxiliary pile 9 for inspection-sheet deposition. Opening cams for opening the grippers are fixedly disposed in the vicinity of the auxiliary pile, because all of the grippers can open at this location. The sheets which follow are then deposited once again on the main pile 6.

The illustrated embodiment of FIG. 1 provides for the return of the inspection sheets onto an auxiliary pile 9 disposed between the conveying chains 7 in a plane above the main pile 6, wherein the spacing or distance between the conveying chains 7 limits the maximum height of the auxiliary pile 9. The sheets cannot, therefore, be removed during the processing of a job, so that any further possibility of manipulating the inspection sheets is excluded. The inspection sheets are removable either upwardly or rearwardly when the conveying chains 7 are stationary.

Instead of such an inspection-sheet deposition onto an auxiliary pile 9 disposed between the conveying chains 7, as is provided with the embodiment of the invention illustrated in FIG. 1, it is also possible for the inspection sheets to be deposited in a cassette 12 disposed above the conveying chains 7, as is illustrated in FIG. 2. Such an arrangement calls for special guidance of the chains 7 and for release of the sheets before their insertion into a fixed-position depository, such as the cassette 12. The inspection sheets are inserted leading-edge first, after the leading thereof has been released by the grippers on the conveying chains 7, into the cassette 12, from which they can be removed, for example, after the prior removal of special safety devices such as lead seals, for example.

Figure 3:
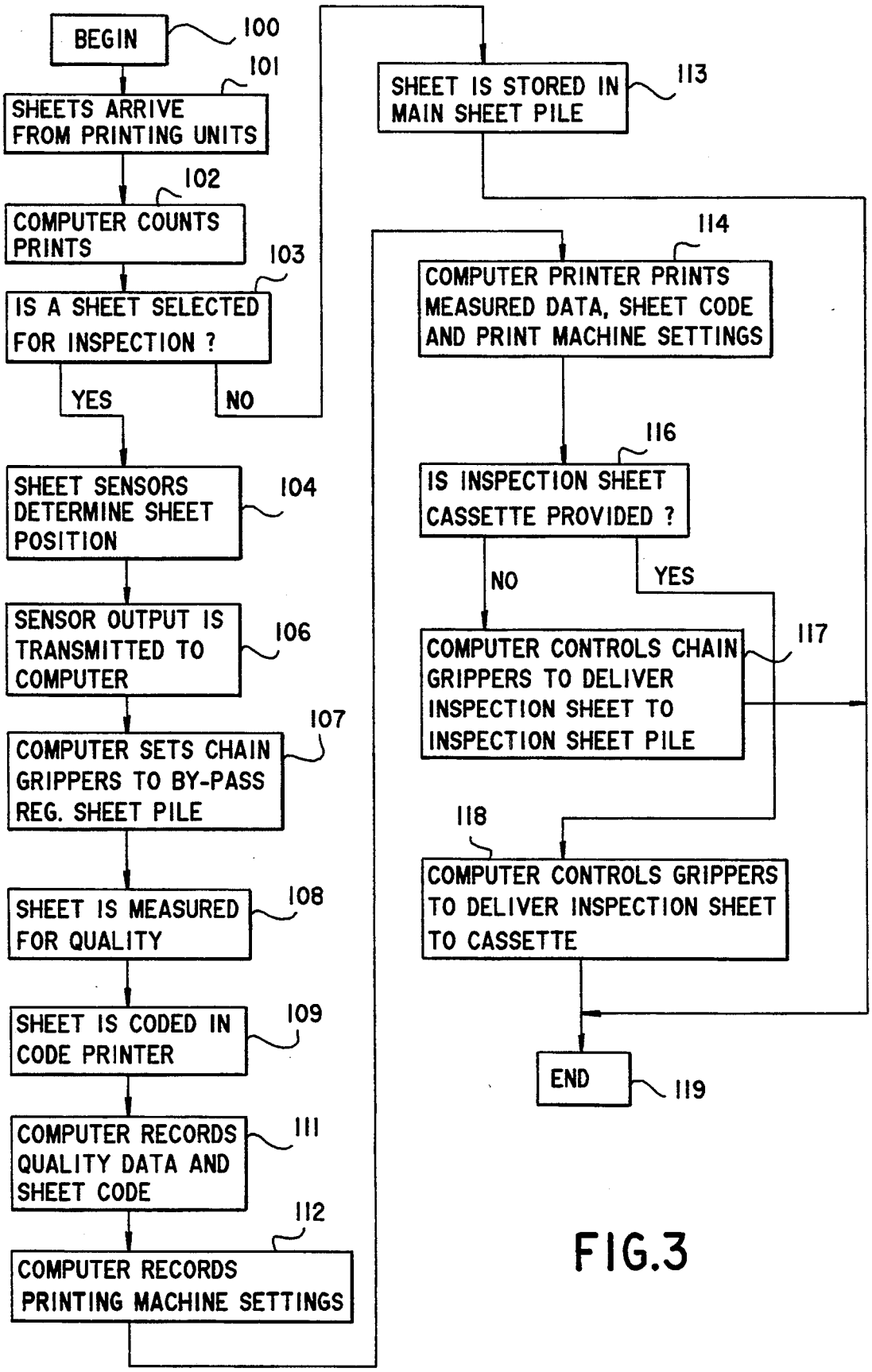
FIG. 3 is a flow chart illustrating the steps for operating the inspection-sheet delivery according to the invention.

FIG. 3 is a flow chart showing the steps of the operation of the invention, wherein the steps represent the function performed by the computer 8. The computer 8 may additionally perform other control functions as required to operate the printing machine, as is well-known from computer controlled printing machines.

After "Begin" (step 100), the sheets arriving from the printing units 1, 2 and 3 on the conveying chains 7 are counted in step 102. The computer selects, in preselected cycles, certain sheets for quality inspection in step 103, and sheets not selected are delivered to the main sheet pile 6 in step 113. The selected sheets pass sheet sensors which determine the exact position of the sheets in step 104. The output of the sheet sensors is transmitted to the computer 8 in step 106 and enables the computer to operate the chain grippers to by-pass the regular sheet pile in step 107. Next, the selected sheets are measured for quality in a conventional quality measuring device (not shown) in step 108. The sheet is then imprinted with a sheet code in a code printer 10 in step 109 under control of the computer 8, and the measured quality data are recorded in the computer together with the imprinted sheet code. Concurrently, the printing machine settings, such as ink distribution dampening data, register data, and so forth, are recorded in the computer together with the afore-mentioned quality data and sheet code in steps 111 and 112. Next, at a convenient time, a computer printer 11 (FIG. 1) can be activated to print out the quality data, i.e. the measured data, the machine settings and the corresponding sheet code, in step 114. Since each sheet was imprinted with its sheet code, all printed inspection sheets can then be reviewed in conjunction with their associated measured quality data and machine settings, and quality discrepancies can be corrected. In case an inspection sheet cassette 12 is provided as shown in step 116 at exit "Yes", the computer 8 is informed of the presence of the cassette, and controls the grippers of the conveying chains 7 so that the selected printed sheet is delivered to the cassette 12 in step 118. If no cassette is provided, the selected sheets are delivered to an inspection sheet pile 9 in step 117, and the selection sheet procedure ends in step 119, to be repeated from step 101 when the next sheet is selected for quality inspection.

I claim:

1. In a sheet-fed rotary printing press, a delivery system comprising at least one main sheet pile, and at least one auxiliary pile for an inspection-sheet delivery; conveying means for transporting sheets; release members for releasing the sheets from said conveying means above one of said main and auxiliary piles; sensor means for detecting the position of the respective sheets, said sensor means having means for emitting electrical pulses to an electronic computer for controlling the printing press, said electronic computer being actuatable for recording measured data, for documenting said measured data with respect to pertinence thereof to respective inspection sheets, for automatically delivering inspection sheets and for setting an inspection-sheet delivery cycle.

2. Delivery system according to claim 1, including a printer for printing said measured data regarding the inspection sheets in conjunction with a code indicating the pertinence of said measured data to the respective inspection sheets, said printer being connected to said computer controlling said inspection-sheet delivery.

3. Delivery system according to claim 2, including means provided in said electronic computer for initiating a signal, by electronic counting, for disabling said release members from releasing the sheets above the main pile, for transporting the sheets by said conveying means to the auxiliary pile for inspection-sheet acceptance, and for actuating fixedly disposed release members to release the sheets above the auxiliary pile.

4. Delivery system according to claim 1, including a coding unit for coding the inspection sheets with pertinent stored data.

5. Delivery system according to claim 4, wherein said coding unit for coding the inspection sheets comprises a printer.

6. Delivery system according to claim 5, wherein said printer is an ink-jet printer.

7. Delivery system according to claim 4, wherein said coding unit for coding the inspection sheets comprises a numbering box.

* * * * *